United States Patent [19]

Huang

[11] Patent Number: 5,005,235

[45] Date of Patent: Apr. 9, 1991

[54] TWO-PERSON SLEEPING BAG FORMED BY TWO SINGLE SLEEPING BAGS

[76] Inventor: Wen-Chen Huang, No. 58, Lane 242, Hu Lin St., Taipei, Taiwan

[21] Appl. No.: 359,964

[22] Filed: Jun. 1, 1989

[51] Int. Cl.[5] ..... A47G 9/08

[52] U.S. Cl. ..... 5/413; 2/69.5

[58] Field of Search ..... 2/69.5; 5/413, 416

[56] References Cited

U.S. PATENT DOCUMENTS

| | | | |
|---|---|---|---|
| 831,733 | 9/1906 | Moore | 5/413 X |
| 2,972,757 | 2/1961 | Adrian | 5/413 X |
| 3,584,323 | 6/1971 | Worley | 2/69.5 |
| 4,513,461 | 4/1985 | Tardivel | 5/413 |

FOREIGN PATENT DOCUMENTS

| | | | |
|---|---|---|---|
| 2305154 | 11/1976 | France | 5/413 |
| 922723 | 4/1963 | United Kingdom | 5/416 |
| 1341960 | 12/1973 | United Kingdom | 5/416 |

*Primary Examiner*—Michael F. Trettel

*Attorney, Agent, or Firm*—Veracity & Forward

[57] ABSTRACT

The present invention concerns a two-person sleeping bag formed by two single sleeping bags each mainly comprises an outer panel made from moisture-proof cloth, and a warm lining disposed inside the outer panel. The edge portion of the outer panel is provided with an outer zipper and an inner zipper parallel to each other; one side of the top end of the outer panel is equipped with a pilow case with a horizontal zipper; the center line of the outer panel has a stitch line. The inner lower end of the outer panel has two lateral zippers, which can close and open both sides of that lower end to insert two soft pads, respectively. A mattress is placed on the warm lining of the outer case, and then a lining panel is placed on the mattress. The edge of the lining panel is provided with a zipper to be fastened together with an outer zipper attached around the edge of the outer panel. The pillow case of the outer panel may receive a pillow pad. In turning over and superimposing one unfolded single sleeping bag on another one and then making the outer zippers thereof match with each other, the two-person sleeping bag is formed.

1 Claim, 4 Drawing Sheets

TWO-PERSON SLEEPING BAG FORMED BY TWO SINGLE SLEEPING BAGS

BACKGROUND OF THE INVENTION:

The conventional sleeping bags may be classified into two types, i.e., the feather sleeping bag and the cotton sleeping bag; in fact, the aforesaid two types of sleeping bags have the same structure except as for the internal filling elements. The conventional sleeping bag usually comprises two layers, i.e., one inner lining and one outer case sewed together; and the edge thereof is usually equipped with a zipper. After the sleeping bag is folded up and edges thereof are joined together, the sleeping bag is formed. When a sleeping bag is unfolded, it looks like a flat pad; however, the conventional sleeping bag has some drawbacks, as follows:

(1) Between the inner lining and the outer case, a given quantity of cotton or feather is filled; then, the two layers are sewed together. Whenever the weather changes, the sleeping bag may either fail to keep the human body warm or provide too much warmth to the user; as a result, the user would hardly get to sleep.

(2) During camping, the sleeping bag, a blanket is usually added anticipating the rapidly changing weather condition; however, the sleeping bag usually is not provided with any means to hold the blanket in the desired place; the blanket is thus susceptible to move away when user turns or moves, and the user would then often have an uncomfortable sleep.

(3) Before sleeping when camping out, the ground surface is first covered with a moisture-proof cloth or a piece of soft pad to pervent water or moisture infiltration, or to alleviate a rough or uneven ground surface. When the sleeping bag is placed separately on a moisture-proof cloth or a soft pad, the sleeping bag is still susceptible to separating from the moisture-proof cloth or the soft pad whenever the person in sleeping bag makes a slight move or turn; the cold air or moisture would then infiltrate into the sleeping bag affecting the person's sleep or health.

(4) When used for a considerably long period of time, the sleeping bag would get an odor from sweat and be contaminated by dirt; therefore the sleeping bag must be cleaned or washed. As the cotton or feathers have been fixedly filled in the sleeping bag, it is quite inconvenient for the user to take out the cotton or feathers before washing the bag.

SUMMARY OF THE INVENTION:

The present invention comprises an outer panel made of a moisture-proof cloth with a zipper attached along the edge thereof, and an inner lining panel equipped with a zipper along the edge therof. The aforesaid two panels can be joined together by means of associating their respective zippers along the edges. A mattress may be disposed between the outer panel and the inner lining panel. The thickness and the material of the mattress may vary in accordance with weather conditions. The outer panel is added with an external layer made from moisture-proof cloth in order to form an envelope in which a soft pad can be removably inserted.

DETAILED DESCRIPTION

Figure 1:
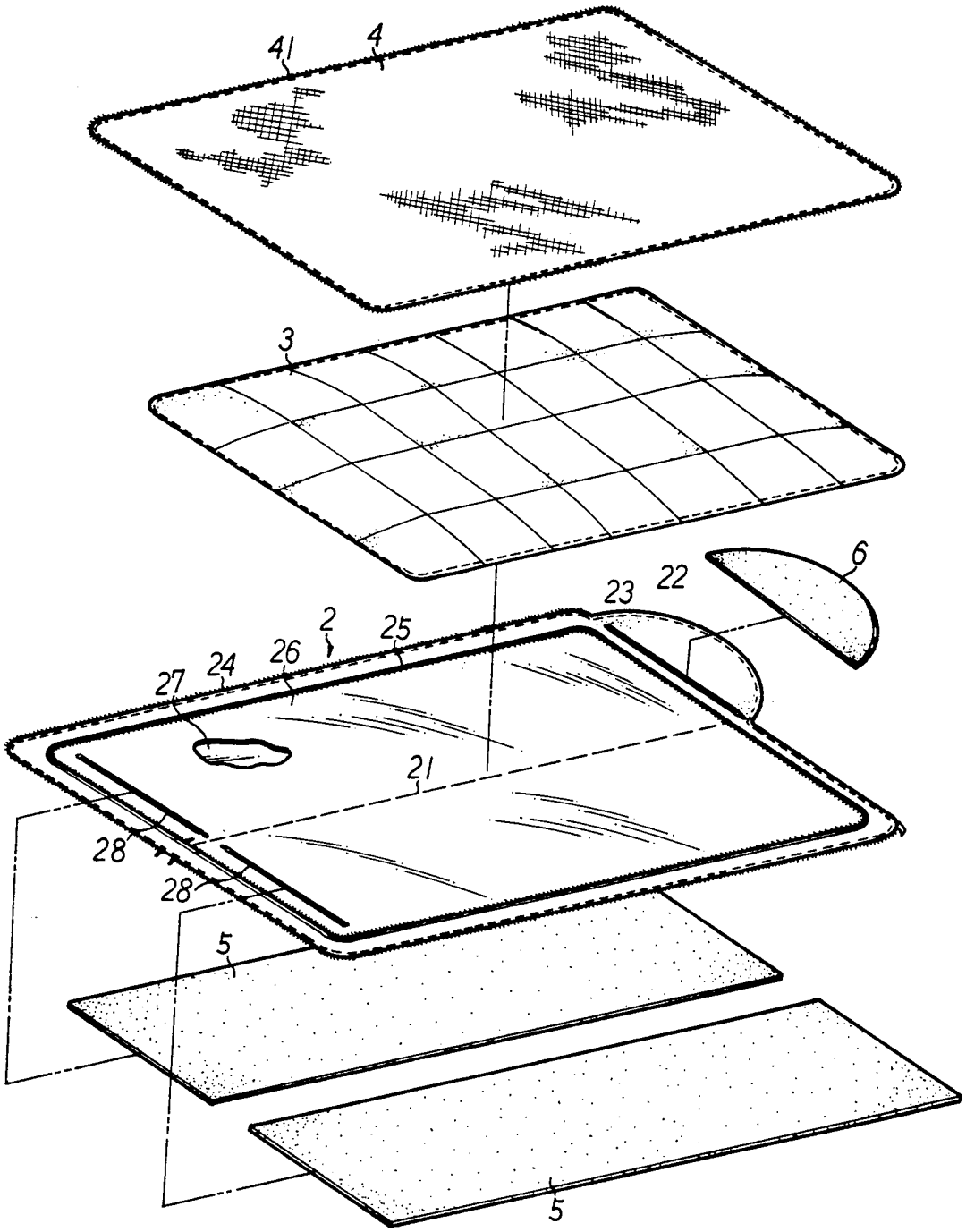
FIG. 1 is a disassembled view of the embodiment according to the present invention, showing every parts unfolded.

FIG. 1 illustrates a disassembled view of an embodiment according to the present invention, comprising an outer panel 2, a mattress 3, a lining panel 4, a soft pad 5, and a semi-circular pillow pad 6. The outer panel 2 can be unfolded into a rectangular shape, in which a stitch line 21 is made, serving as a folding line. The top end of one side of the outer panel has a semi-circular pillow case 22 extending outwardly therefrom; the pillow case is provided with a zipper 23, which can close and open the pillow case so as to insert a semi-circular pillow pad 6 therein to form a pillow. There is an outer zipper 24 attached around three edges, except the top edge, of the outer panel 2. Futhermore, along the inner edge of the outer panel 2, there is an inner zipper 25; both of these zippers 24 and 25 are sewed onto the outer panel parallely.

Panel 2 is made from two layers of cloth, the inner layer of which is a warm lining 26 in order to maintain the warm air, while the outer layer is a moisture-proof cloth 27 preventing the cold air and moisture from infiltrating therein. The warm lining has two parallel zippers 28, and is used for enveloping two soft pads 5. The pads 5 are used for providing a comfortable base for the user.

The lining 4 is provided with a zipper 41 extending around the edge thereof, and the zipper 41 can be fastened together with the inner zipper 25 attached around the outer panel 2; the mattress 3 is to be disposed between the lining 4 and the warm lining 26 of the outer panel 2.

Figure 2:
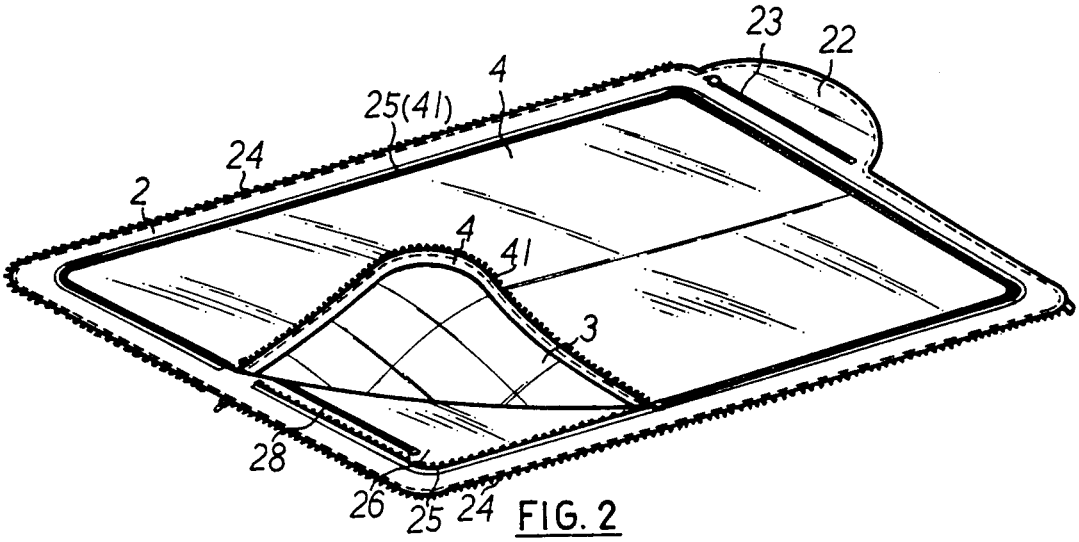
FIG. 2 is a perspective view of the present invention in an assembled state.

Please refer to FIG. 2. It shows that the mattress 3 is inserted between the warm lining 26 of the outer panel 2 and lining 4. The soft pad 5 is inserted in the outer panel 2.

Figure 3:
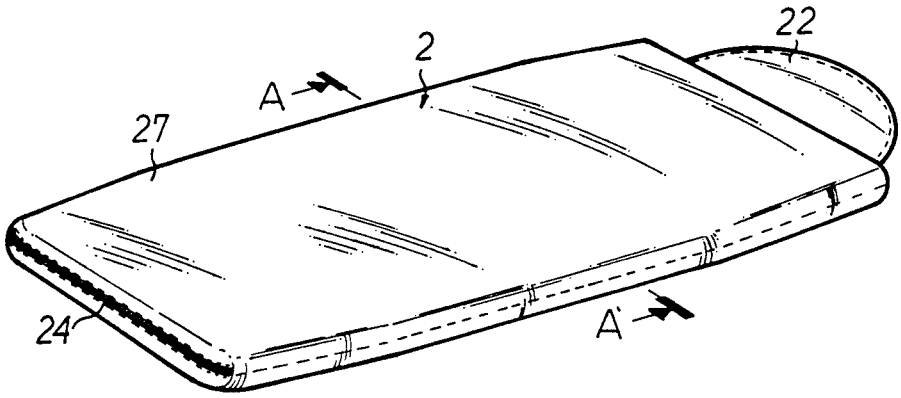
FIG. 3 illustrates the folded up present invention wherein the edge portion is fastened together via zipper means to form a sleeping bag.

Please refer FIG. 3. The sleeping bag is folded up along the stitch line in the center thereof, and is fastened via the outer zipper 24 to form a sleeping bag.

Figure 4:
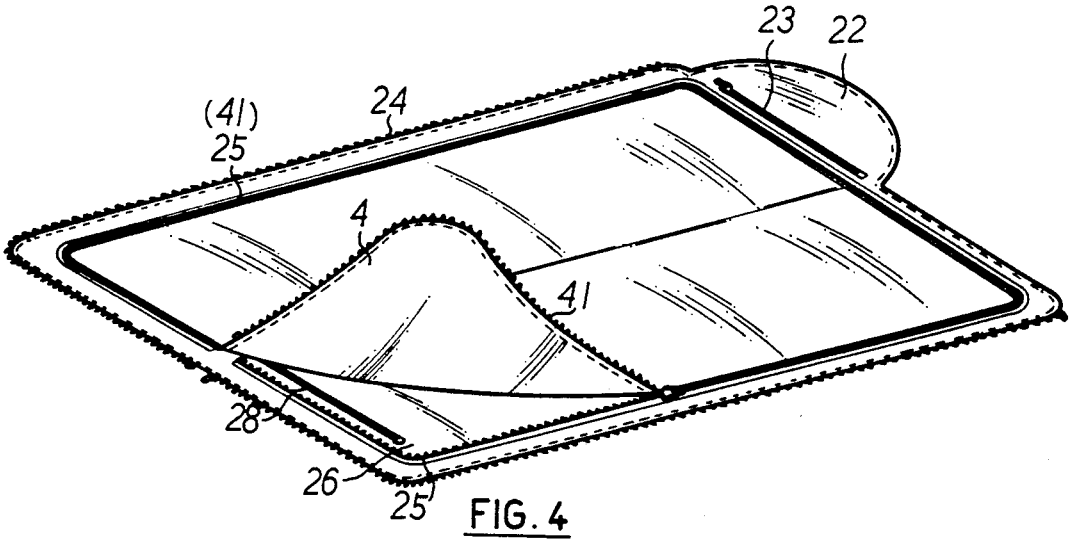
FIG. 4 is an unfolded view according to FIG. 2 with the mattress between the outer panel and the lining panel removed.

Please refer to FIG. 4, in which the mattress 3 is removed from the outer panel 2 and the lining 4; the sleeping bag thus becomes such thinner, and is good for use in summer time.

Figure 5:
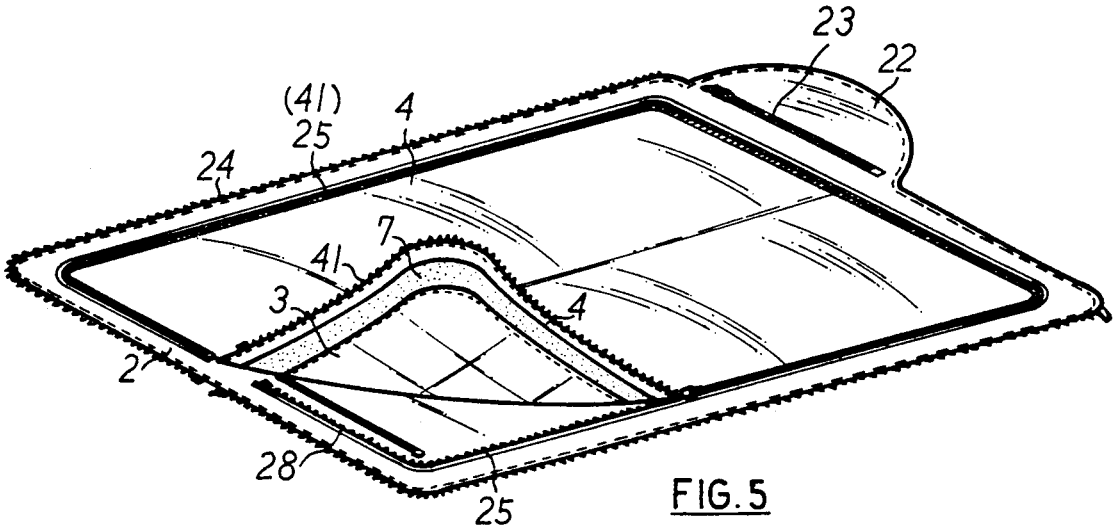
FIG. 5 is an unfolded view according to FIG. 2 with a mattress and a blanket placed between the outer panel and the lining panel.
Figure 6:
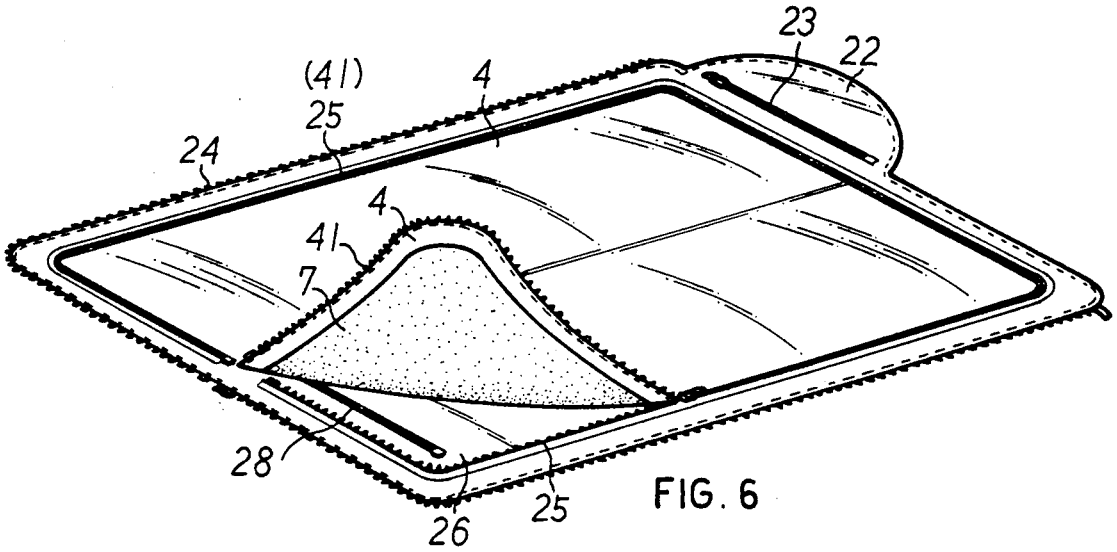
FIG. 6 is an unfolded view according to FIG. 2 with a blanket placed between the outer panel and the lining panel.

Please refer to FIG. 5, in which a mattress 3 and a blanket 7 are inserted between the outer case 2 and the lining 4. The sleeping bag thus becomes much thicker, being good for use in cold weather.

please refer to FIG. 6, in which a blanket 7 is inserted between the outer panel 2 and the lining 4; here the sleeping bag is good for use in fall or in a cool weather. Briefly, the present invention according to FIGS. 4, 5 and 6 may be varied in structure for use during different weather conditions; therefore, the present invention is deemed different from the conventional sleeping bags because it is changeable for different seasons.

Figure 7:
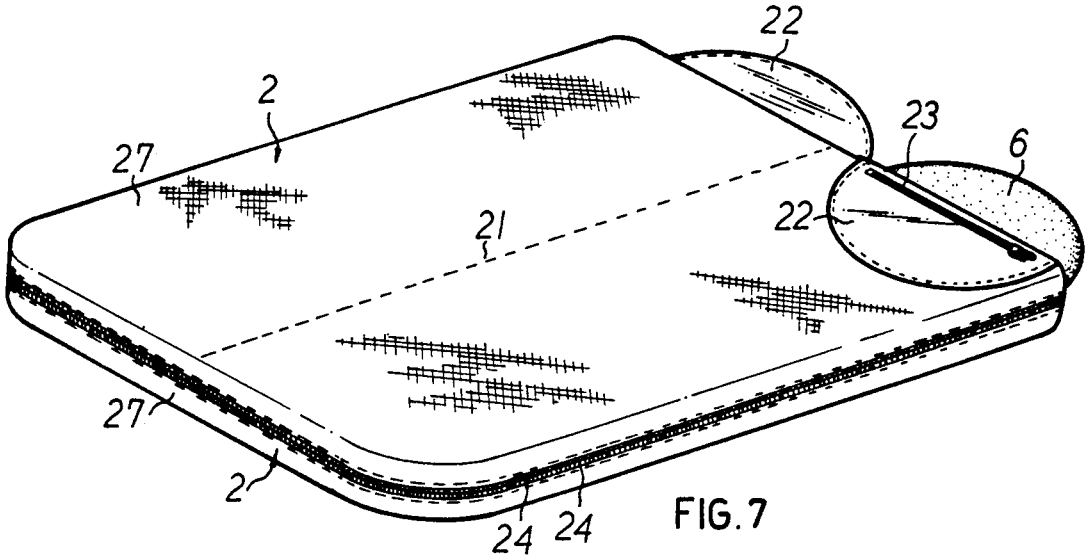
FIG. 7 is a perspective view of an embodiment of a two-person sleeping bag, according to the present invention.

FIG. 7 illustrates one embodiment of the present invention, wherein a two-person sleeping bag is formed by two unfolded single sleeping bags, as mentioned above by means of turning over and superimposing one unfolded single sleeping bag on the other, and then making the outer zippers 24 thereof matching with each other associating said two single sleeping bags. However, when two unfolded single sleeping bags are associated together to serve as a sleeping bag for two persons, one of two semi-circular pillow cases will be in an opposite upper position as shown in FIG. 7 in that case, the pillow pad in the opposite upper pillow case may be taken out to be put on ground surface to serve as a pillow.

Figure 8:
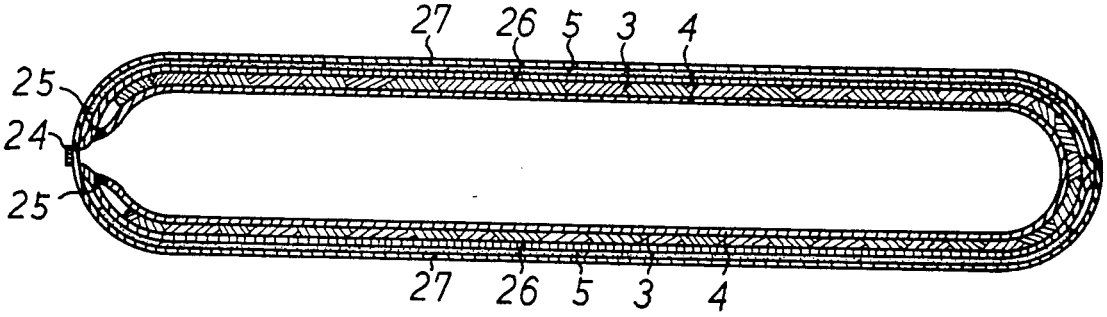
FIG. 8 is a cross-sectional view of the present invention taken along line A—A in FIG. 3.

FIG. 8 illustrates a sectional view of the present invention taken alone line A—A in FIG. 3; FIG. 8 shows the moisture-proof cloth 27 being directly in contact with the ground surface and the warm lining 26 placed inside the sleeping bag. Between the moisture-proof cloth 27 and the warm lining 26, there is disposed a soft pad 5; the mattress 3 is placed between the outer panel 2 and lining 4. After the sleeping bag is folded up, the outer zipper 24 can fasten the two opposite edges of the bag together to form a sleeping bag.

I Claim:

1. A sleeping bag comprising a flexible casing (2) that includes an outer panel (27) and an inner panel (26); each panel having two longitudinal side edges a longitudinal centerline defined therebetween, and two transverse end edges; each panel being generally rectangular except that each panel has an integral pillow case extension at one end thereof offset to one side of the panel longitudinal centerline; said panel and associated extensions being secured together around their peripheral edges to form a hollow sealed casing and integral pillow case; said panels being stitched together along the panel longitudinal centerline; said outer panel (27) being formed of a moisture-impervious cloth material; said inner panel (26) having a first zipper opening (at 23) extending transversely across the associated pillow case extension; said inner panel having a second zippered opening (at 28) extending transversely thereacross at the end thereof remote from the first zippered opening;

a pillow (6) insertable through the first zippered opening to occupy the hollow space defined by the pillow case extensiions;

an elongated generally rectangular pad (5) formed of a soft cushion material insertable through the second zippered opening to form a cushion underneath the body of a person lying within the sleeping bag;

a generally rectangular liner panel (4) having longitudinal and transverse dimensions slightly less than the corresponding dimensions of said flexible casing (2);

a first inner zipper means (25) extending around substantially the entire periphery of said flexible casing along the surface thereof defined by said inner panel (26); said first zipper means being inset from the edges of the case so that the extreme outer edge area of the case is located outwardly beyond said inner zipper means including a first portion thereof inset inwardly from the first zippered opening (23), and a second portion thereof spaced outwardly beyond the second zippered opening (28);

a second zipper means (41) extending along the peripheral edges of said liner panel (4); said second zipper means being adapted to mate with said first zipper means (25) whereby said liner panel can be releasably attached to the flexible case at the panel peripheral edges.

a generally rectangular mattress (3) having a plan dimension slightly less than the space circumsribed by the first and second zipper means, whereby said mattress can be inserted into the space between the liner panel and the flexible casing;

and a third outer zipper means (24) extending only along the two longitudinal slide edges of said casing and the end edge of said casing remote from the pillow case extensions;

said flexible casing being foldable on its longitudinal centerline so that portions of said third zipper means mate together, whereby said third zipper means can be closed to form a bag seal along the entire folded bag edge except for the edge area thereof defined by the pillow case.

* * * * *